US008450864B2

(12) United States Patent
Kawakita et al.

(10) Patent No.: US 8,450,864 B2
(45) Date of Patent: May 28, 2013

(54) ARRANGEMENT STRUCTURE FOR CONTROL BOX AND ELECTRIC POWER CONVERTER IN FRAME-MOUNTED ENGINE GENERATOR

(75) Inventors: Keisuke Kawakita, Osaka (JP); Shohei Amakawa, Osaka (JP); Kazutoshi Inayoshi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 405 days.

(21) Appl. No.: 12/736,746

(22) PCT Filed: Apr. 24, 2009

(86) PCT No.: PCT/JP2009/058149

§ 371 (c)(1), (2), (4) Date: Nov. 5, 2010

(87) PCT Pub. No.: WO2009/136555

PCT Pub. Date: Nov. 12, 2009

(65) Prior Publication Data

US 2011/0057454 A1 Mar. 10, 2011

(30) Foreign Application Priority Data

May 7, 2008 (JP) ..... 2008-121526

(51) Int. Cl.
*F02B 63/04* (2006.01)

(52) U.S. Cl.
USPC ..... 290/1 A; 361/679.01

(58) Field of Classification Search
USPC ..... 290/1 A
See application file for complete search history.

(56) References Cited

U.S. PATENT DOCUMENTS

| | | | | |
|---|---|---|---|---|
| 5,515,235 | A * | 5/1996 | Stoller | 361/605 |
| 6,378,468 | B1 | 4/2002 | Kouchi et al. | |
| 6,946,602 | B1 * | 9/2005 | Gibbs et al. | 174/560 |
| 7,277,273 | B2 * | 10/2007 | Smith et al. | 361/679.01 |
| 7,728,225 | B2 * | 6/2010 | Anderson et al. | 174/50 |

(Continued)

FOREIGN PATENT DOCUMENTS

| | | |
|---|---|---|
| CN | 1117922 C | 8/2003 |
| CN | 1328491 C | 7/2007 |

(Continued)

OTHER PUBLICATIONS

International Search Report dated Jun. 9, 2009, issued for PCT/JP2009/058149.

(Continued)

*Primary Examiner* — Michael Zarroli
(74) *Attorney, Agent, or Firm* — Edwards Wildman Palmer LLP; James E. Armstrong, IV; George N. Chaclas

(57) ABSTRACT

A frame-mounted engine generator includes a frame (2) having an engine (10), an engine-driven electric generator (11), an electric power converter (14) that converts generated electric power to a prescribed frequency, and a control box (17) having an internal control circuit board (16) for a radiator fan or other such accessory equipment, the control box and the electric power converter are arranged in stacked fashion in that order as one proceeds toward an interior direction relative to a frame open face, and is such that a hinge (21) provided at one edge of the control box causes the control box to be constituted so as to be rotatable.

7 Claims, 8 Drawing Sheets

U.S. PATENT DOCUMENTS

| | | | | |
|---|---|---|---|---|
| 7,978,460 | B2 * | 7/2011 | Dykes | 361/641 |
| 8,154,857 | B2 * | 4/2012 | Kendall et al. | 361/679.01 |
| 2006/0054113 | A1 * | 3/2006 | Yasuda et al. | 123/41.65 |
| 2010/0110634 | A1 * | 5/2010 | Woodbury et al. | 361/698 |

FOREIGN PATENT DOCUMENTS

| | | | |
|---|---|---|---|
| CN | 101016858 | A | 8/2007 |
| EP | 1069293 | B1 | 1/2001 |
| JP | 61-27929 | U | 2/1986 |
| JP | 63-187507 | U | 12/1988 |
| JP | 2002-242760 | A | 8/2002 |
| JP | 2005-117808 | A | 4/2005 |
| JP | 2006-009809 | A | 1/2006 |
| JP | 2008-035591 | A | 2/2008 |

OTHER PUBLICATIONS

Office Action issued Jul. 3, 2012 for corresponding Chinese Application No. 200980116192.

* cited by examiner

ARRANGEMENT STRUCTURE FOR CONTROL BOX AND ELECTRIC POWER CONVERTER IN FRAME-MOUNTED ENGINE GENERATOR

TECHNICAL FIELD

The present invention relates to arrangement structure(s) for control box(es) and electric power converter(s) in frame-mounted engine generator(s) such as might be employed in cogeneration apparatus(es) or the like.

BACKGROUND ART

Frame-mounted engine generators such as might be employed in cogeneration apparatuses or the like have conventionally been such that mounted within a frame there are: an engine, an engine-driven electric generator, an inverter (electric power converter) that converts generated electric power to a prescribed frequency, and a control panel (control box) having an internal control circuit board for a radiator fan or other such equipment.

Moreover, in the context of such a frame-mounted engine generator in which an engine, an electric generator, and so forth are mounted within a frame, a constitution in which the inverter is arranged at a rotary inner door (housing case) at the lower portion of the frame has been disclosed for improved internal equipment maintenance characteristics (see, for example, Patent Reference No. 1).

PRIOR ART REFERENCES

Patent References

PATENT REFERENCE NO. 1: Japanese Patent Application Publication Kokai No. 2002-242760

SUMMARY OF INVENTION

Problem to be Solved by Invention

However, in the frame-mounted engine generator of the prior art reference, the inverter is arranged at a side face of the frame, and furthermore, the control panel is arranged at a front face thereof. Because the inverter and control panel are thus arranged in disparate fashion at side and front faces of the frame, there is an inconvenience in that location must be changed when this inverter and this control panel are undergoing concurrent maintenance operations.

The present invention therefore addresses the problem of arranging an electric power converter such as an inverter, and a control box having an internal control circuit board for the engine and/or the radiator fan or other such accessory equipment, in concentrated fashion at the same face so as to achieve improved ease of operations with respect to maintenance and so forth of the electric power converter and the control box.

Means for Solving Problem

The present invention, being conceived in order to solve the aforesaid problem, in the context of a frame-mounted engine generator in which mounted within a frame there are an engine, an engine-driven electric generator, an electric power converter that converts generated electric power to a prescribed frequency, and a control box having an internal control circuit board for a radiator fan or other such accessory equipment, is such that the control box and the electric power converter are arranged in stacked fashion in that order as one proceeds toward an interior direction relative to a frame open face, is such that a hinge provided at one edge of the control box causes the control box to be of rotatable constitution, is such that equipment subject to human manipulation at the electric power converter is exposed in opposed fashion with respect to the control box back face, and is such that there is an opening at a location on the control box back face that is opposed to the equipment subject to human manipulation at the electric power converter.

In such present invention, because an electric power converter and a control box are arranged in concentrated fashion at the same face, the need to change location in the event that both are to undergo concurrent maintenance operations is eliminated, resulting in more improved ease of maintenance.

In the aforesaid present invention, in the context of a frame-mounted engine generator, the electric power converter and the controller box are arranged at a lower portion of the frame. In such present invention, because the electric power converter, which is a heavy component, and the control box, which is also a heavy component inasmuch as it has internal inductor(s), transformer(s), and so forth, are arranged at a lower portion of the frame, it is to that extent possible to lower the center of mass of the frame-mounted engine generator and improve the earthquake-resistant characteristics thereof.

In the aforesaid present invention, in the context of a frame-mounted engine generator, provided at a back face of the electric power converter there is an output terminal block at which electric power that has been converted to prescribed frequency is routed to the frame exterior.

In such present invention, the need for having wiring within the frame to make connection between the electric power converter and the output terminal block is eliminated. Furthermore, because the electric power converter is arranged at a lower portion of the frame, the length of that portion of the output line leading to the exterior that is within the frame can be reduced.

In the aforesaid present invention, in the context of a frame-mounted engine generator, a wiring routing hole is provided at a location that is on a bottom face of the frame and that is in the vicinity of the output terminal block. In such present invention, because the output line is routed to the exterior from the bottom face of the frame, the need to route the output line about the periphery of the frame-mounted engine generator is eliminated.

In the aforesaid present invention, in the context of a frame-mounted engine generator, a ventilation duct having an intake fan is provided at a location that is behind the control box and that is below the electric power converter; and through-holes are respectively provided at ventilation duct and control box back face. In such present invention, negative pressure within the ventilation duct causes generation of airflow directed from the back face of the control box toward the interior of the ventilation duct, permitting cooling of the control box.

In the aforesaid present invention, in the context of a frame-mounted engine generator, separate from the intake fan of the ventilation duct, a cooling intake fan is provided at the electric power converter; a ventilating airstream produced by said cooling intake fan is used to cool the electric power converter and thereafter combines with one or more other airstreams within the ventilation duct; and the ventilation duct is connected to a partitioned engine chamber whereat the engine is arranged. In such present invention, because the combined airstreams from both the intake fan at the ventilation duct and the cooling intake fan at the electric power converter can be drawn into the engine chamber, it is possible to increase the size of the airstream(s) that ventilate the engine chamber. Furthermore, the negative pressure within the ventilation duct also causes increase in the size of the intake airstream(s) at the intake fan that cools the electric power converter.

In the aforesaid present invention, in the context of a frame-mounted engine generator, the electric power converter is mounted over the ventilation duct. In such present invention, the need to separately provide support member(s) for the electric power converter is eliminated, and it is also possible to carry out cooling of the electric power converter by virtue of heat transfer to the ventilation duct.

BENEFIT OF INVENTION

In the present invention, because an electric power converter and a control box are arranged in concentrated fashion at the same face, the need to change location in the event that both are to undergo concurrent maintenance operations is eliminated, resulting in more improved ease of maintenance.

EMBODIMENTS FOR CARRYING OUT INVENTION

Below, embodiments of the present invention are described with reference to the drawings.

FIG. 1 through FIG. 8 show an embodiment in which the present invention is applied to a cogeneration apparatus 1. Note that cogeneration apparatus 1 refers to a system, where a commercial electric power subsystem of an external commercial power supply and an electric power generation subsystem of an electric generator are connected to an electric power delivery subsystem that delivers electric power to electric power consuming equipment (load), that meets the electric power demand of said load, that recovers waste heat generated in accompaniment to electric power generation, and that utilizes said recovered heat.

Figure 7:
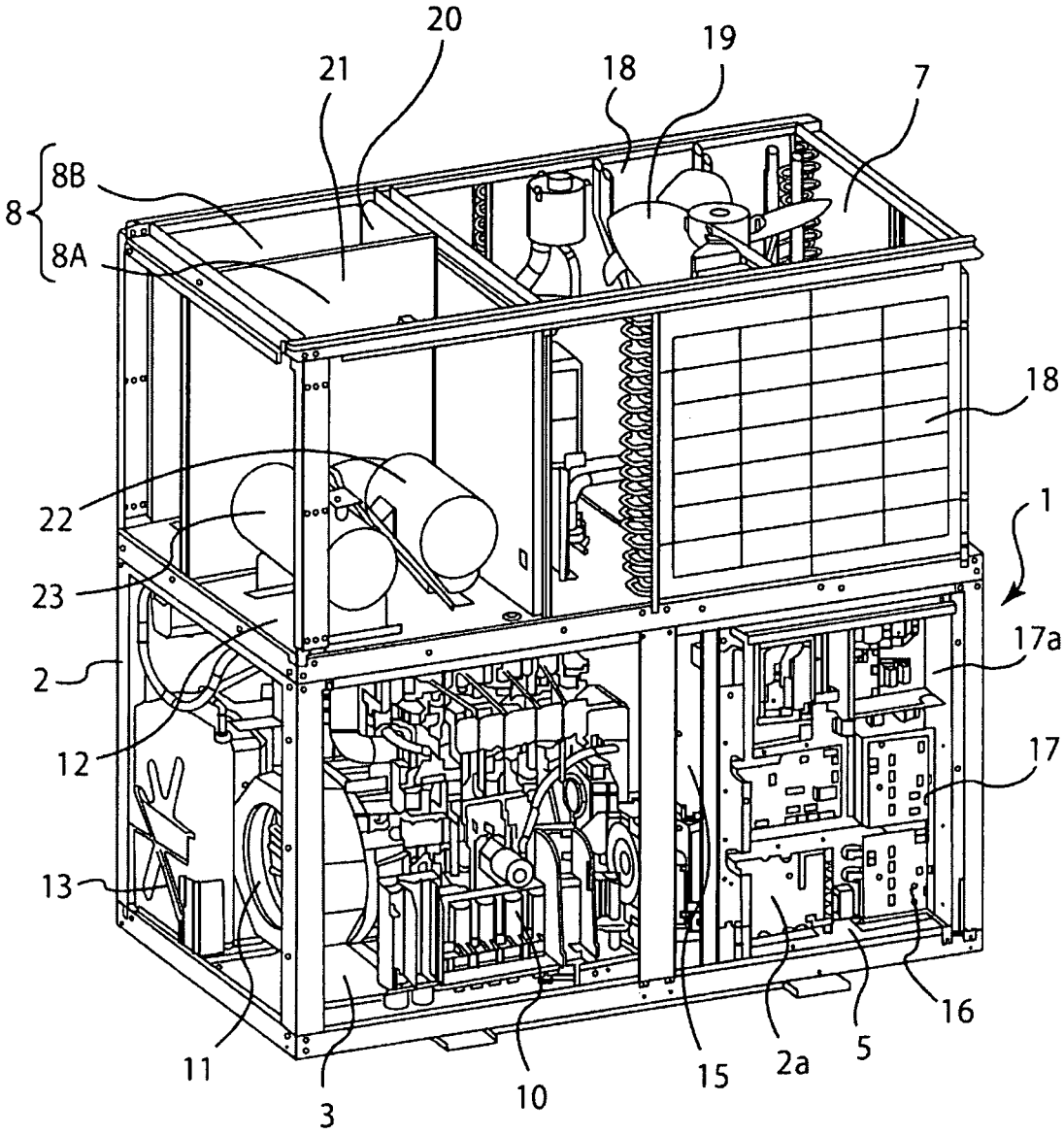
FIG. 7 is a front perspective view showing the entirety of same cogeneration apparatus.
Figure 8:
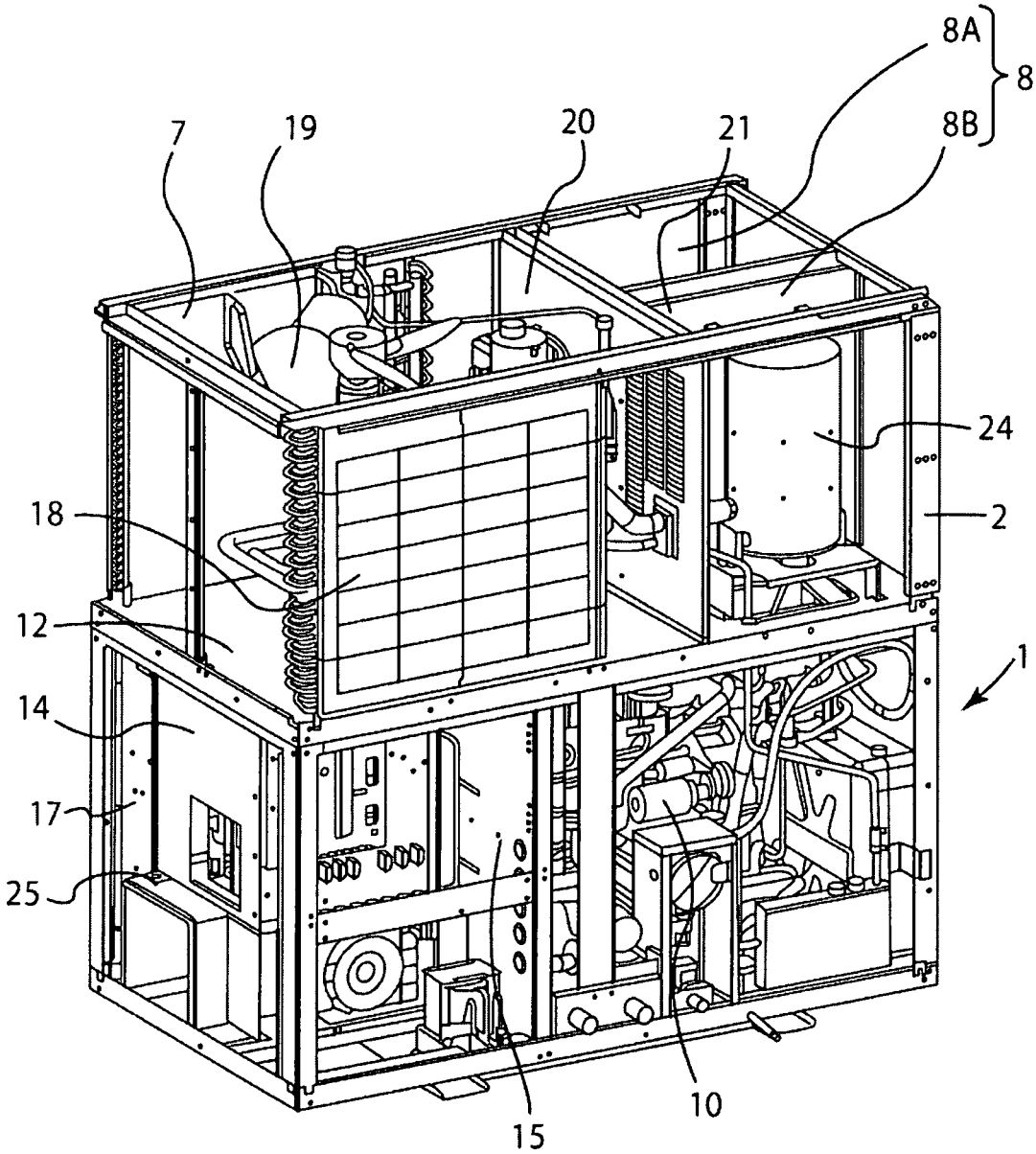
FIG. 8 is a rear perspective view showing the entirety of same cogeneration apparatus.

FIG. 7 shows a front perspective view of a cogeneration apparatus, and FIG. 8 shows a rear perspective view of same apparatus. As shown in FIG. 7 and FIG. 8, cogeneration apparatus 1 associated with the present embodiment is equipped with frame 2 which is formed in roughly rectangular parallelepiped fashion. The interior of this frame 2 is divided vertically into two regions by intermediate wall 12 located approximately midway in the vertical direction of frame 2, the lower region comprising engine chamber 3 and equipment housing chamber 5, and the upper region comprising radiator chamber 7 and intake/exhaust chamber 8.

The aforesaid engine chamber 3 is disposed to one side in a long direction of the frame 2. Arranged within this engine chamber 3 there are an engine 10, an electric generator 11 driven by this engine 10, an oil tank 13, and various items including a coolant pump, an exhaust gas heat exchanger, and a liquid-liquid heat exchanger which are not shown in the drawings. Note that a gas engine may for example be employed as engine 10, said engine 10 driving electric generator 11 in rotational fashion in linked accompaniment with respect thereto.

The aforesaid radiator chamber 7 is arranged above equipment housing chamber 5, radiator 18 being arranged within the radiator chamber 7, and heat-dissipating radiator fan 19 being arranged above radiator chamber 7.

Radiator chamber 7 and intake/exhaust chamber 8 are partitioned by partition 20. Intake/exhaust chamber 8 is partitioned into intake chamber 8A and exhaust chamber 8B by partition 21. Respectively arranged at intake chamber 8A are air cleaner 22 and intake silencer 23. Arranged at exhaust chamber 8B is exhaust silencer 24.

The aforesaid equipment housing chamber 5 is arranged to the side (right side as shown in FIG. 7) of engine chamber 3. This equipment housing chamber 5 is partitioned from engine chamber 3 by partition 15. Arranged within equipment housing chamber 5 there are a control box 17 and an inverter 14 serving as electric power converter. That is, control box 17 and inverter 14 are arranged in stacked fashion in that order as one proceeds toward an interior direction relative to a frame open face (the open front face of equipment housing chamber 5) 2*a*. Note that frame open face 2*a* is ordinarily openably closed off by a cover which is not shown in the drawings.

Inverter 14, which is a heavy component, and control box 17, which is also a heavy component inasmuch as it has internal inductor(s), transformer(s), and so forth, are arranged at a lower portion of frame 2, and so to that extent the center of mass of cogeneration apparatus 1 is lowered and improvement in the earthquake-resistant characteristics thereof is achieved.

Figure 1:
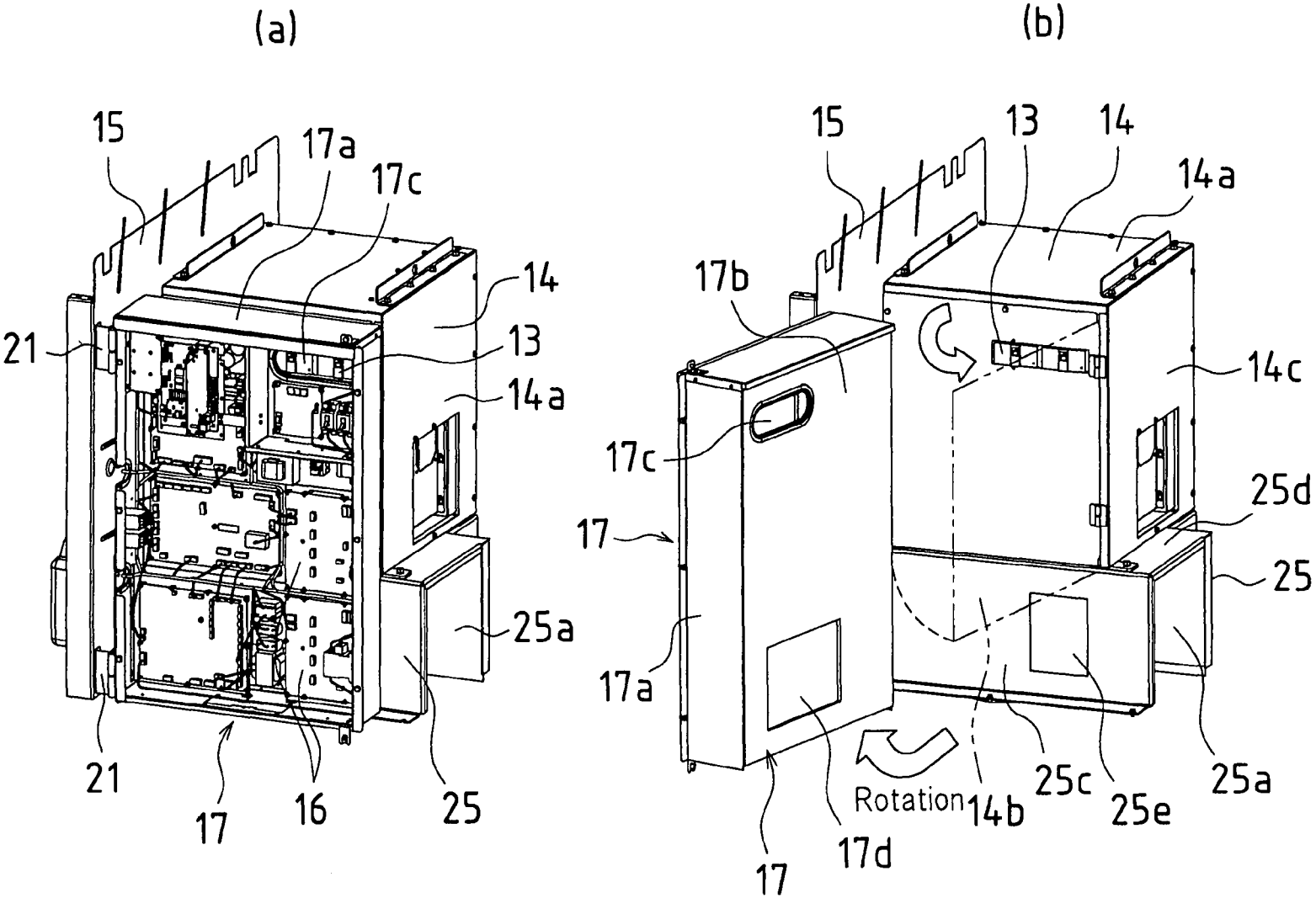
FIG. 1 shows an inverter and a control box associated with one embodiment of the present invention, (a) being a perspective view showing the situation that exists when the control box is closed, and (b) being a perspective view showing the situation that exists when the control box is open.
Figure 4:
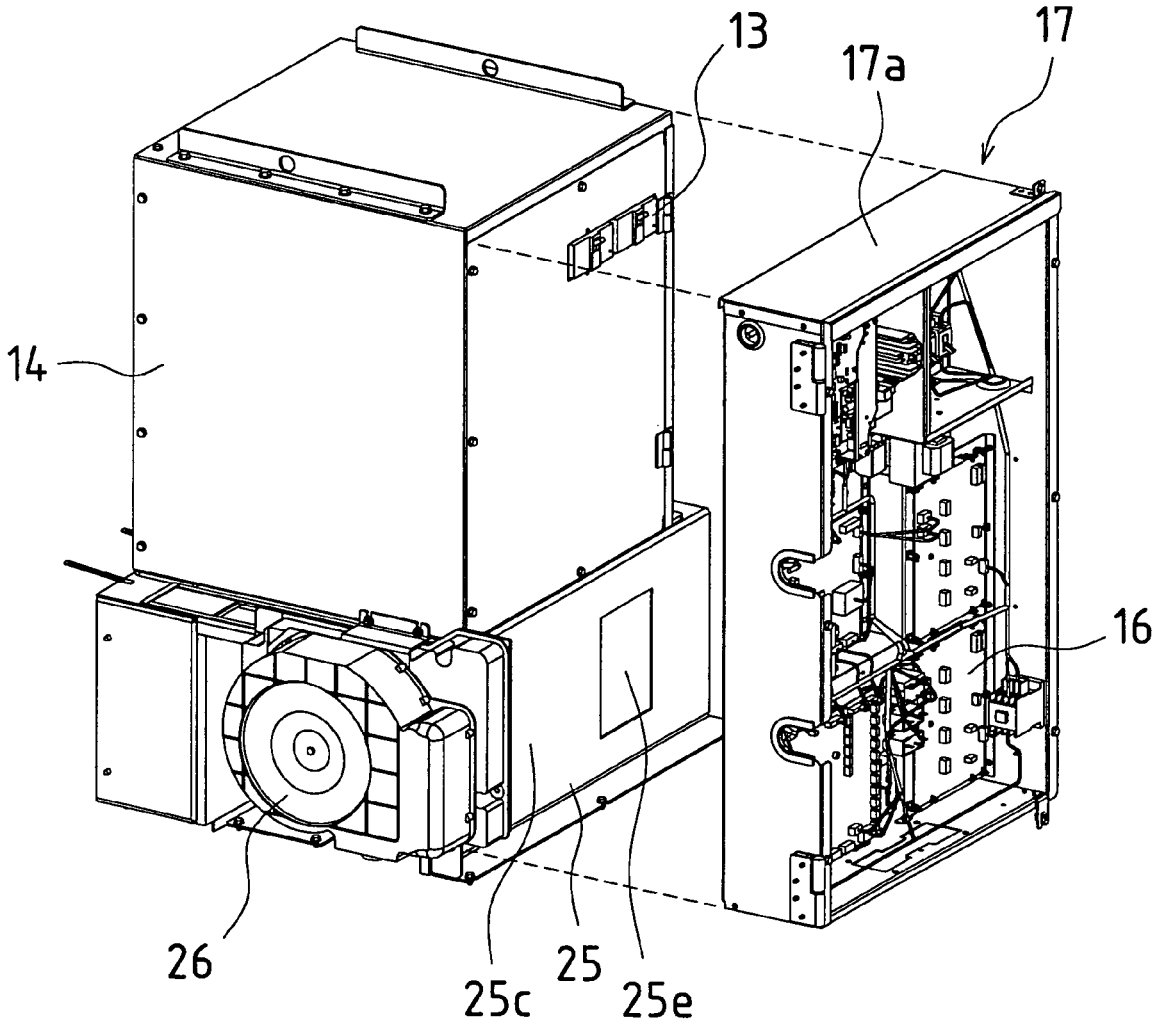
FIG. 4 is a perspective exploded view of the inverter and the control box in same cogeneration apparatus.

As shown in FIG. 1 and FIG. 4, control box 17 is rectangular as viewed from the front and is such that various internal components including control circuit board(s) 16 for radiator fan(s) and/or other such accessory equipment are disposed within box body 17*a*, the front face of which is open. Furthermore, hinge(s) 21 are provided at one edge of box body 17*a*, box body 17*a* being rotatably attached by way of hinge(s) 21 to the front edge of the aforesaid partition 15. Accordingly, control box 17 is capable of being opened and closed as it goes between a closed position at which it overlaps inverter 14, and an open position reached by rotation about hinges 21 serving as pivots.

Formed at the upper portion of the box body back face 17*b* is an opening 17*c*, operation of circuit breaker(s) or other such component(s) (equipment subject to human manipulation) 13 provided on the front face of inverter 14 being for example made possible from this opening 17*c*. Furthermore, formed at the lower portion of box body back face 17*b* is through-hole 17*d*.

Figure 2:
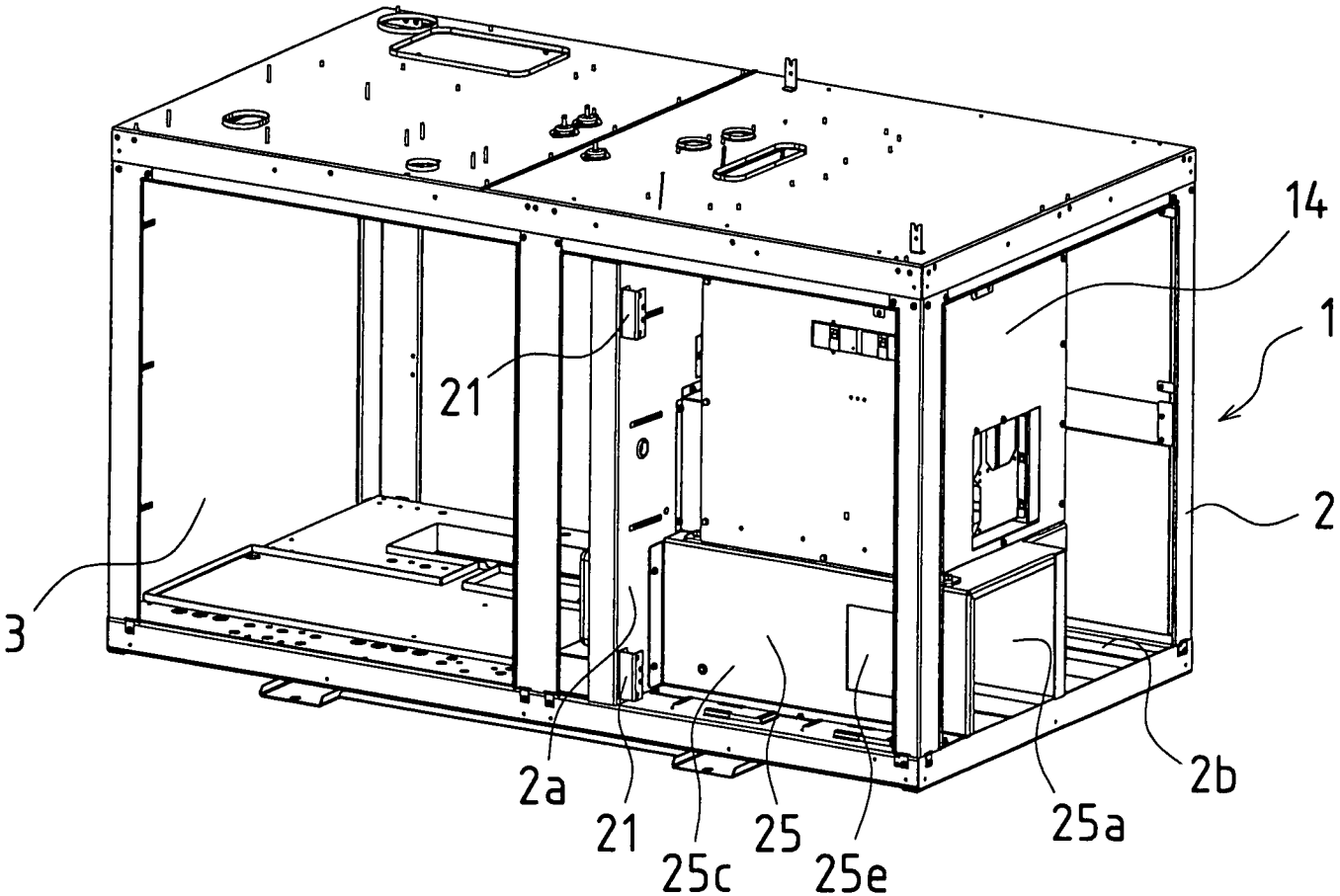
FIG. 2 is a front perspective view showing a lower portion of the frame in same cogeneration apparatus.

As shown in FIG. 2, at equipment housing chamber bottom face 2*b* of frame 2, ventilation duct 25 for capturing outside air is provided in the long direction of frame 2. One end of ventilation duct 25 serves as an intake port 25*a* that opens onto the side face of frame 2. Connected to the other end of ventilation duct 25 is engine chamber intake fan 26 which is arranged at the engine chamber 3 side, suction from this engine chamber intake fan 26 causing outside air captured from intake port 25*a* to flow within ventilation duct 25 and into engine chamber 3.

Ventilation duct 25 is provided behind the control box, and through-hole 25*e*, which matches the aforesaid through-hole 17*d* at box body back face 17*b*, is formed at ventilation duct front wall 25*c*, the interior of control box 17 and the interior of ventilation duct 25 communicating by way of respective through-holes 17*d*, 25*e*.

Figure 3:
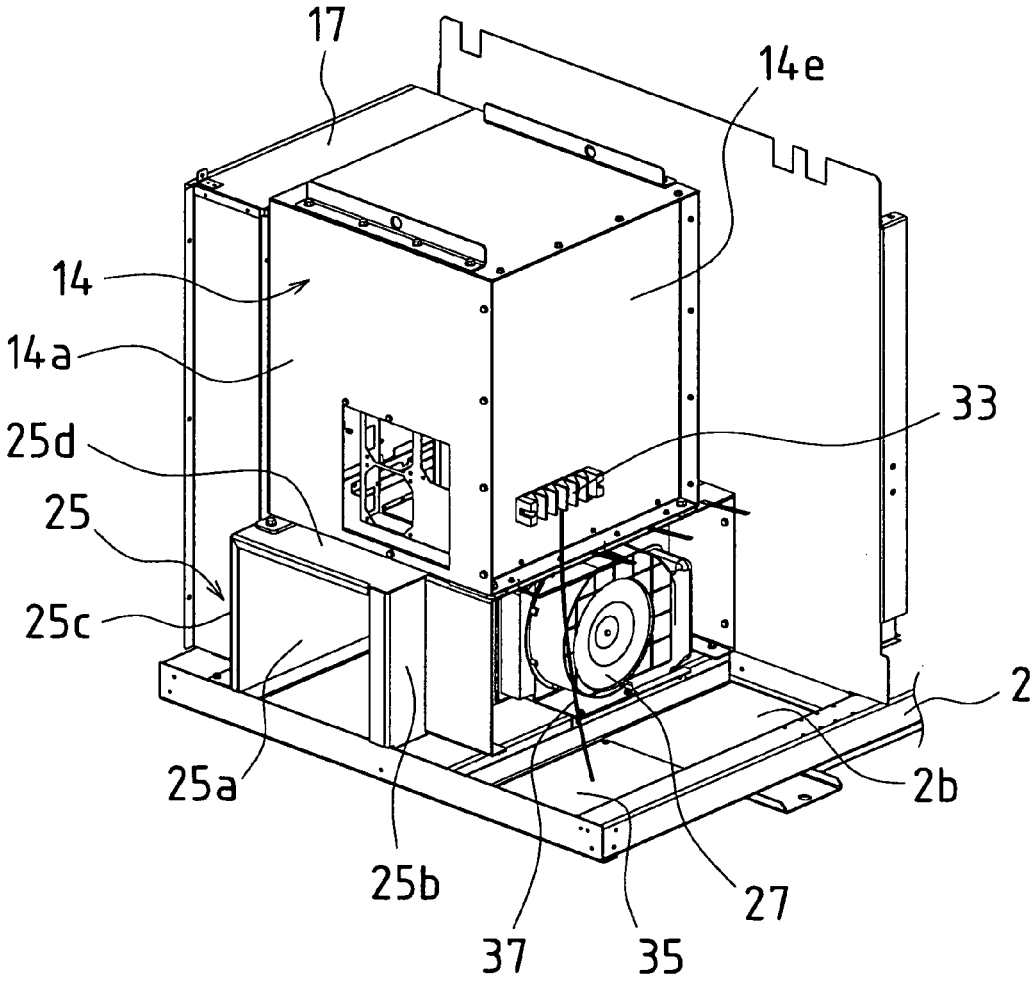
FIG. 3 is a rear perspective view of an equipment housing chamber in same cogeneration apparatus.
Figure 6:
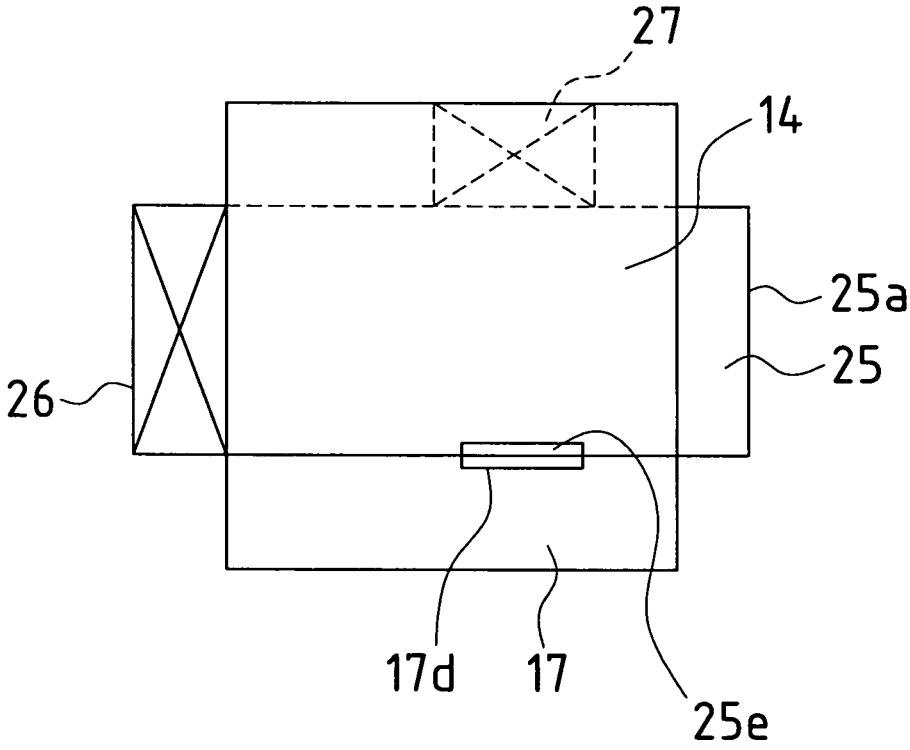
FIG. 6 is a plan view showing in schematic fashion the equipment housing chamber in same cogeneration apparatus.

Furthermore, as shown in FIG. 3 and FIG. 6, intake fan 27 is provided at ventilation duct rear wall 25*b*. This intake fan 27 draws air from equipment housing chamber 5 into ventilation duct 25.

Inverter 14 is mounted at ventilation duct top wall 25*d*. Inverter 14, which converts generated electric power to prescribed frequency, is equipped with inverter body 14*a* and inverter door 14*b* which closes off the opening at the inverter body front face. Moreover, the bottom face of inverter body 14*a* is in direct contact with ventilation duct top wall 25*d*.

Figure 5:
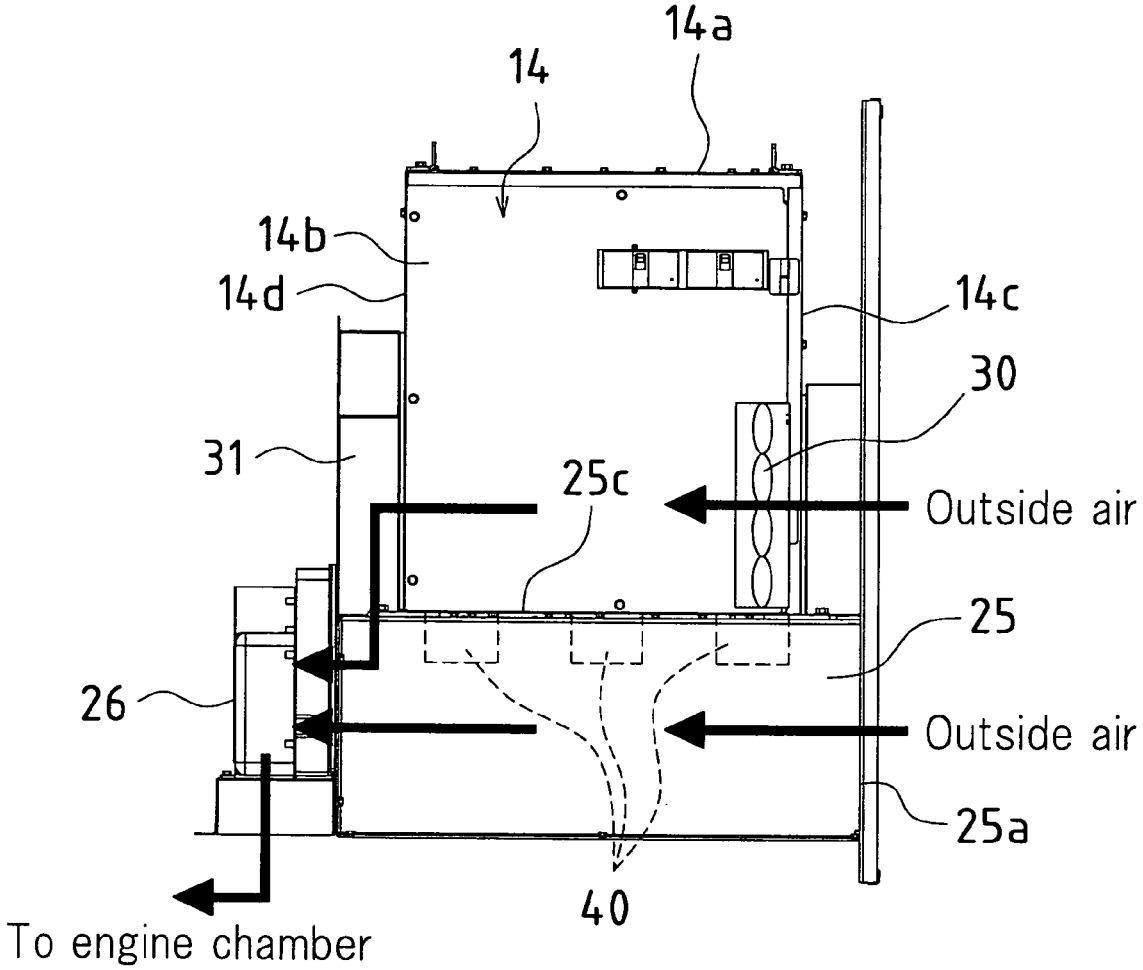
FIG. 5 is a front view showing in schematic fashion the equipment housing chamber in same cogeneration apparatus.

Furthermore, as shown in FIG. 5, one inverter side face (the face on the same side as intake port 25*a* of ventilation duct 25) 14*c* is provided with cooling intake fan 30 for capturing outside air and bringing it into the inverter interior, the aforesaid engine chamber intake fan 26 and inverter intake fan 30 being arranged in series.

Provided at the other side face (the face on the engine chamber 3 side) 14*d* of the inverter body is intake passage 31, by means of which the interior of inverter 14 communicates with ventilation duct 25. Accordingly, outside air which is brought into the interior of inverter 14 by cooling intake fan 30, being made to flow in the same direction as the outside air within ventilation duct 25, combines with the outside air in ventilation duct 25 and is carried to engine chamber 3.

As shown in FIG. 3, secured to inverter back face 14*e* is output terminal block 33, at which electric power that has been converted to prescribed frequency is routed to the frame exterior. Furthermore, wiring routing hole 35 is formed at a location that is on the equipment housing chamber bottom face 2*b*, i.e., the frame bottom face, and that is below the vicinity of the aforesaid output terminal block 33. Moreover, output line 37 connected to output terminal block 33 is inserted through wiring routing hole 35 and is routed to the exterior from equipment housing chamber bottom face 2*b*.

Cogeneration apparatus 1 of the present embodiment having the foregoing constitution, path(s) taken by ventilating air when such apparatus 1 is in operation will next be described.

When engine 10 is running, respective fans 26, 27, and 30 also operate in accompaniment to running of that engine 10.

Suction from engine chamber intake fan 26 causes outside air to be brought into ventilation duct 25 from intake port 25*a*, the outside air brought thereinto flowing along ventilation duct 25 to enter engine chamber 3. Furthermore, because the interior of control box 17 and the interior of ventilation duct 25 communicate by way of respective through-holes 17*d*, 25*e*, negative pressure at ventilation duct 25 causes generation of airflow directed from the back face of control box 17 toward the interior of ventilation duct 25, permitting cooling of the interior of control box 17.

Furthermore, outside air is captured and brought into inverter 14 by cooling intake fan 30, and is moreover drawn along by engine chamber intake fan 26, the outside air cooling electronic components and so forth as it flows along the interior of inverter 14, to enter engine chamber 3. Thus, because the combined airstreams from both engine chamber intake fan 26 and cooling intake fan 30 can be drawn into engine chamber 3, it is possible to increase the size of airstream(s) that ventilate engine chamber 3.

In addition, because the outside air flowing along the interior of inverter 14 is drawn along by negative pressure created by suction from engine chamber intake fan 26, it is also possible to increase the size of the airstream(s) that cool the inverter.

Moreover, because inverter 14 is arranged above ventilation duct 25, it is possible to use outside air flowing along the interior of ventilation duct 25 to remove heat from the bottom face of inverter 14 by means of heat transfer, making it possible to suppress increase in temperature of inverter 14.

The situation that exists when carrying out operations for maintenance and so forth at control box 17 and inverter 14 will next be described.

First, when carrying out maintenance at control box 17, because control box 17 is provided at a location that is on the front face of frame 2 and that is to the front of inverter 14, maintenance personnel can carry out operations from the front face of frame 2 while control box 17 is closed (see FIG. 1 (*a*)).

Furthermore, because control box 17 is provided with opening 17*c*, such opening 17*c* serves as access hole, making it possible for maintenance personnel to carry out circuit breaker actuation or other such ordinary operations at inverter 14 while control box 17 is closed.

When carrying out maintenance operations on inverter elements, components, or the like within inverter 14, control box 17 is opened to its open position (see FIG. 1 (*b*)). With control box 17 in this open position, it is possible to expose the front face of inverter 14. Moreover, maintenance personnel can open inverter door 14*b* and carry out maintenance operations on inverter 14.

Moreover, following completion of maintenance operations at inverter 14, in the reverse of the foregoing, inverter door 14*b* is closed and control box 17 is closed. Thus, the need for maintenance personnel to change location in order to carry out maintenance operations on both control box 17 and inverter 14 is eliminated, resulting in more improved ease of maintenance.

The present invention is not limited to the foregoing embodiment. For example, as indicated by the imaginary line at FIG. 5, cooling fin(s) 40 might be installed so as to project downward from the bottom face of inverter body 14*a*, and such that these cooling fins 40 jut into the interior of ventilation duct 25. Furthermore, these cooling fins 40 will permit further improvement in heat-dissipating effect at inverter 14.

Furthermore, it is also possible to employ the present invention in a GHP (gas heat pump).

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

Moreover, this application claims priority based on Patent Application No. 2008-121526 filed in Japan on 7 May 2008. The content thereof is hereby incorporated in the present application by reference.

Potential Industrial Use

The present invention is effective in a frame-mounted engine generator in which an electric power converter such as an inverter, and a control box having an internal control circuit board for an engine and/or radiator fan or other such accessory equipment, are mounted on a frame; and is particularly suited to use in a GHP (gas heat pump) or a cogeneration system.

EXPLANATION OF REFERENCE NUMERALS

1 Cogeneration apparatus
2 Frame
3 Engine chamber
5 Equipment housing chamber
7 Radiator chamber
10 Engine
11 Electric generator
14 Inverter (electric power converter)
16 Control circuit board
17 Control box
18 Radiator
19 Radiator fan
20 Partition
21 Hinge
26 Engine chamber intake fan
27 Intake fan
30 Cooling intake fan
33 Output terminal block
35 Wiring routing hole
37 Output line

The invention claimed is:

1. A frame-mounted engine generator comprising:

a frame defining a frame open face;

an engine supported by the frame;

an engine-driven electric generator supported by the frame;

an electric power converter, supported by the frame, that converts generated electric power to a prescribed frequency;

a control box, supported by the frame, having an internal control circuit board for a radiator fan or other such accessory equipment, the control box having a back face;

an arrangement structure for the control box and the electric power converter in the frame-mounted engine generator characterized in that the control box and the electric power converter are arranged in stacked fashion in that order as one proceeds toward an interior direction relative to the frame open face;

a hinge provided at one edge of the control box that causes the control box to be-of rotatable constitution; and equipment subject to human manipulation at the electric power converter exposed in opposed fashion with respect to the control box back face; wherein there is an opening at a location on the control box back face that is opposed to the equipment subject to human manipulation at the electric power converter.

2. A frame-mounted engine generator according to claim 1, wherein the arrangement structure for the control box and the electric power converter in the frame-mounted engine generator is characterized in that the electric power converter and the controller box are arranged at a lower portion of the frame.

3. A frame-mounted engine generator according to claim 2, wherein the arrangement structure for the control box and the electric power converter in frame-mounted engine generator is characterized in that at a back face of the electric power converter there is an output terminal block at which electric power that has been converted to the prescribed frequency is routed to the frame exterior.

4. A frame-mounted engine generator according to claim 3, wherein the arrangement structure for the control box and the electric power converter in the frame-mounted engine generator is characterized in that a wiring routing hole is provided at a location that is on a bottom face of the frame and in a vicinity of the output terminal block.

5. A frame-mounted engine generator according to claim 2, wherein the arrangement structure for the control box and the electric power converter in the frame-mounted engine generator is characterized in that a ventilation duct having an intake fan is provided at a location that is behind the control box and that is below the electric power converter; and through-holes are respectively provided at the ventilation duct and the control box back face.

6. A frame-mounted engine generator according to claim 5, wherein the arrangement structure for the control box and the electric power converter in the frame-mounted engine generator is characterized in that, separate from the intake fan of the ventilation duct, a cooling intake fan is provided at the electric power converter; wherein a ventilating airstream is produced by said cooling intake fan to cool the electric power converter and thereafter combines with one or more other airstreams within the ventilation duct; and the ventilation duct is connected to a partitioned engine chamber whereat the engine is arranged.

7. A frame-mounted engine generator according to claim 6, wherein the arrangement structure for the control box and the electric power converter in the frame-mounted engine generator is characterized in that the electric power converter is mounted over the ventilation duct.

* * * * *